United States Patent [19]

Chen

[11] Patent Number: 4,889,335

[45] Date of Patent: Dec. 26, 1989

[54] COMPOUND BICYCLE EXERCISING APPARATUS

[75] Inventor: Pao-Chaing Chen, Taichung, Taiwan

[73] Assignee: Diversified Investments Corporation, Madison, Wis.

[21] Appl. No.: 264,094

[22] Filed: Oct. 28, 1988

[51] Int. Cl.[4] ..... A63B 21/00; F16H 21/18

[52] U.S. Cl. ..... 272/73; 74/48

[58] Field of Search ..... 272/73, 72, 97, 71, 272/116, 131, 132, 134; 74/48, 47

[56] References Cited

U.S. PATENT DOCUMENTS

| | | | |
|---|---|---|---|
| 110,057 | 12/1870 | Maltby | 74/48 |
| 3,966,201 | 6/1976 | Mester | 272/73 |
| 4,586,706 | 5/1986 | Chen | 272/73 |
| 4,622,793 | 11/1986 | Oki | 74/48 |
| 4,657,244 | 4/1987 | Ross | 74/48 |

*Primary Examiner*—Stephen R. Crow

*Attorney, Agent, or Firm*—Haight & Hofeldt

[57] ABSTRACT

An exercise bicycle is disclosed comprising: a frame; energy absorbing structure rotated on the frame about a first shaft; a transmission for free wheeling a second shaft using at least one foot pedal, for rotatably connecting the first shaft and the second shaft, for rotating a roller eccentrically through a predetermined orbit relative to a third shaft and for rotatably connecting the third shaft to free the second shaft; a pivot arm which is pivotally mounted at one end to the frame and which has an opposite end which is adapted to be pulled by the human hand; and yoke structure for coupling the arm to the roller such that reciprocating motion of the arm is translated to rotation of the third shaft.

12 Claims, 1 Drawing Sheet

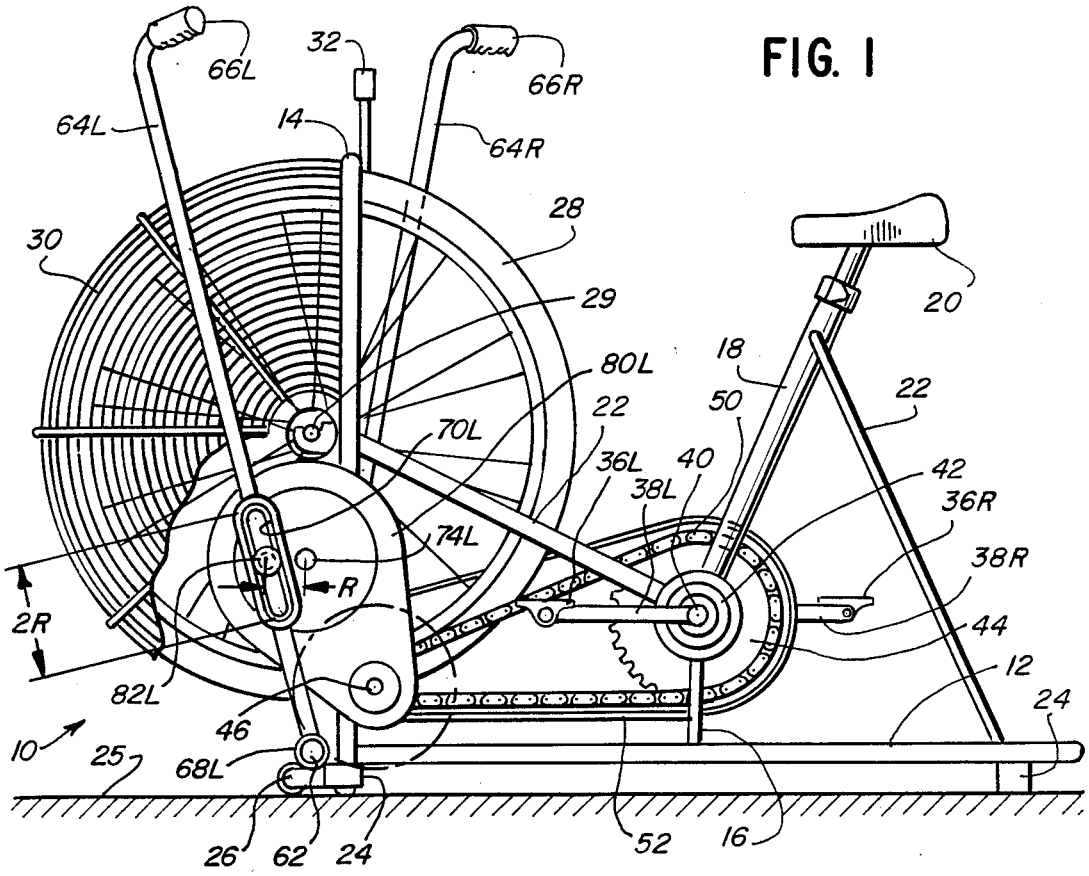
FIG. 1
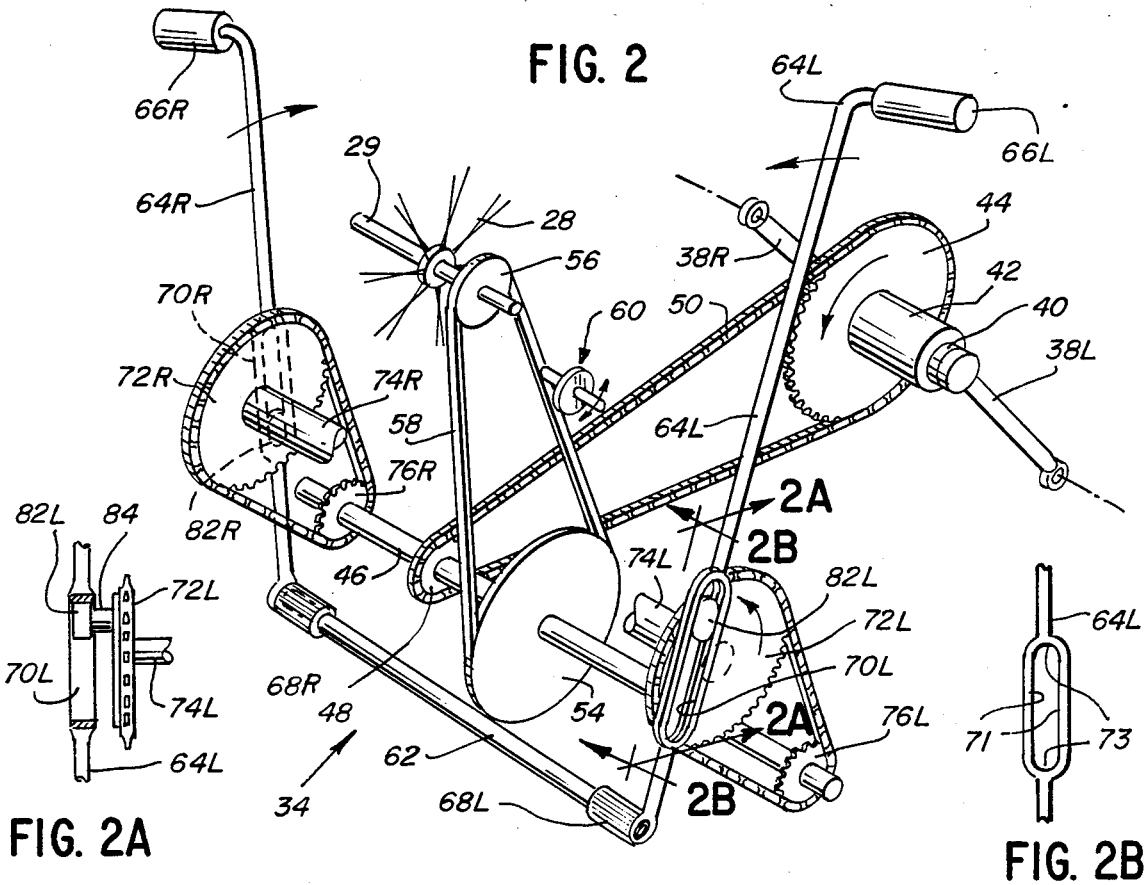
FIG. 2
FIG. 2A
FIG. 2B

COMPOUND BICYCLE EXERCISING APPARATUS

TECHNICAL FIELD

This invention relates to the general subject matter of exercising machines, and in particular, to the subject of exercising bicycles.

BACKGROUND OF THE INVENTION

With the increased awareness of the importance of physical health and aerobic exercise, exercise bicycles have become increasingly popular. In the beginning these bicycles were basically stationary versions of an ordinary two wheel bicycle; that is, the user would operate a pair pedals to rotate a loaded wheel not in contact with the ground. These basic machines have the disadvantage of only exercising muscles of the legs or lower torso of the user.

More recently, bicycle exercising machine were developed to exercise muscle groups in the upper part of the body. Two examples are provided in U.S. Pat. Nos. 4,188,030 and 4,657,244. Basically speaking, they are an improvement over U.S. Pat. No. 326,247. In the '247 patent, two sets of pivot arms were operated by the legs and forearms of the user and the arms were linked by an eccentric to drive a flywheel The linkage required that the human legs and arms move together in synchronism. Thus, both the upper and lower body muscle groups had to be exercised at the same time. This is a decided disadvantage to those users who would like to develop one muscle group in preference to the other. One embodiment of the '244 patent allows the pedals to be disengaged so that the arms can be exercised alone. However, because of the number of gears and chain drives, all embodiments of the '244 patent are relatively noisy. Moreover, the nature of the eccentric is not conducive to smooth operation.

What is needed is a smooth running exercising machine which can be used at the option of the user to exercise the muscles of the upper body or the muscles of the lower body or both the muscles of the upper and lower body. Preferably, such an exercising machine should be quiet, smooth running, easy to use, and simple to assemble or trouble shoot. It should also be one which would not inconvenience the user by moving parts of user's body which are not being exercised.

SUMMARY OF THE INVENTION

In accordance with the present invention, an exercise bicycle is disclosed comprising: a frame; energy absorbing means rotated on the frame about a first shaft; means for free wheeling a second shaft using at least one foot pedal; means for rotatably connecting the first shaft and the second shaft; means for rotating a roller eccentrically through a predetermined orbit relative to a third shaft; means for rotatably connected the third shaft to free wheel the second shaft; an arm which is pivotally mounted at one end to the frame and which has an opposite end which is adapted to be stroked by the human hand; and yoke means for coupling the pivoted arm to the roller such that reciprocating motion of the pivoted arm is translated to rotation of the third shaft and hence the energy absorbing means.

Since the second shaft is free wheeling (i.e., free wheelingly driven by the foot pedal and the arm), the energy absorbing means can be rotated by the user's arms alone, by the user's feet alone, or by a combination of both. Another benefit is that the same exercise machine can be used to exercise separate muscle groups at the option of the user. Moreover, this option does not require the user to make or break mechanical connections.

Numerous other advantages and features of the present invention will become readily apparent from the following detailed description of the invention, the embodiments described therein, from the claims, and from the accompanying drawings.

BRIEF DESCRIPTION OF THE DRAWINGS

FIG. 1 is a side elevational view of an exercise bicycle incorporating the present invention;

FIG. 2 is a mechanical schematic diagram of the drive mechanism that is used in the exercise bicycle of FIG. 1;

FIG. 2A is a partial, cross-sectional, side view of the roller mechanism shown in FIG. 2; and FIG. 2B is a partial plan view of the yokes shown in FIG. 2.

DETAILED DESCRIPTION OF THE PREFERRED EMBODIMENT

While this invention is susceptible of embodiment in many different forms, there is shown in the drawings and will herein be described in detail several specific embodiments of the invention. It should be understood, however, that the present disclosure is to be considered as an exemplification of the principles of the invention and is not intended to limit the invention to the specific embodiments illustrated.

Turning to FIG. 1, an exercise bicycle 10 that is the present invention is illustrated. That bicycle comprises a frame 12, a front support 14, a rear support 16, a seat support 18, a seat 20, and associated frame stiffening members 22. For supporting the exercise bicycle 10 on the floor 25 or other surface, pads or stabilizers 24 are provided. For moving the exercise bicycle 10 over the floor 25 or other surface, one or more dolly wheels 26 are provided and connected to the frame 12.

The front support 14 provides support for energy-absorbing means or bicycle wheel 28 through an axle 29 at the front end of the exercise bicycle 10. For the most part, energy is absorbed in such a wheel through the flywheel effect. Energy absorption may be enhanced by adding paddles or blades to the spokes of the wheel 28 or by the addition of a braking mechanism which will retard rotation of the wheel. A protective cage 30, supported by the front support 14, is used to protect the user from contact with the moving parts of the energy-absorbing wheel 28. The front support 14 also provides a convenient mounting for a speedometer, odometer, stop watch, clipboard or other monitoring instrument 32. The rear support 16 mounts a pair of right and left foot pedals 36R and 36L.

The energy-absorbing wheel 28 is rotated by the mechanism 34 depicted in FIG. 2. There the mechanism 34 that is used to rotate the energy-absorbing wheel 28 is schematically depicted. The pedals 36R and 36L are connected to pedal crank arms 38R and 38L which are keyed to a pedal shaft 40. The pedal shaft 40 is mounted for rotation in a bearing block 42 which is carried by the bicycle frame 12. The pedal shaft 40 is keyed to a primary sprocket wheel 44.

Turning now to the front end of the mechanism 34 of FIG. 2, the bicycle frame 12 supports a central shaft 46.

To simplify the drawings, the bearing support blocks for the central shaft (and the other rotating shafts) are not shown. Such support devices are well known to those skilled in the art. A secondary sprocket wheel 48 is free wheelingly (e.g., by a one-way clutch) connected to the central shaft 46. A sprocket chain 50 connects the primary sprocket wheel 44 to the secondary sprocket wheel 48 on the central shaft 46. A chain guard or cover 52 (see FIG. 1) protects the user of the exercise bicycle 10 from contact with the chain and sprocket teeth.

Also connected to the central shaft 46 is a primary pulley 54. The primary pulley 54 is rotatably connected to a secondary pulley 56 through a elastomeric or rubber-like belt 58. The secondary pulley 56 is keyed to the axle of the energy-absorbing wheel 28. Preferably, the belt is a ribbed V-belt. One advantage of this arrangement for driving the energy-absorbing wheel 28 is that the belt 58 effectively isolates the energy-absorbing wheel from the various chain drives, thereby resulting in a quieter machine.

The tension between the belt 58 and the two pulleys 54 and 56 can be adjusted by means of a tensioner 60.

Located at the lower front end of the bicycle frame 12 is a pivot shaft 62. A pair of arms 64R and 64L are located at each end of the pivot shaft 62 and on opposite sides of the energy-absorbing wheel 28. The upper end of each arm 64R and 64L is provided with a hand grip 66R and 66L. The lower end of each arm is connected by a bushing 68R and 68L to the pivot shaft 62. Located intermediate the ends of each arm 64R and 64L is a elongated yoke 70R and 70L.

Also located at each side of the energy-absorbing wheel 28 are a pair of arm powered primary sprocket wheels 72R and 72L. The arm powered primary sprocket wheels are rotatably connected to shafts 74R and 74L carried by the bicycle frame 12 Free wheelingly connected to the ends of the central shaft 46 are two arm driven secondary sprocket wheels 76R and 76L. The arm driven secondary sprocket wheels are connected to the arm driven primary sprocket wheels 72R and 72L by chains 78R and 78L. A cover 80R and 80L protects the user from the teeth of the sprocket wheels and the rotating chain.

Eccentrically located on the outside face of each arm driven secondary sprocket wheels 76R and 76L is a roller wheel 82R and 82L (see FIG. 2A). The roller wheels 82R and 82L are supported for rotation about a shaft 84 that is eccentrically mounted to or carried by the outside face of the arm powered primary sprocket wheels 72R and 72L, whereby the roller wheels rotate in an orbit of radius "R" (see FIG. 1) relative to the axis of the two shafts 74R and 74L of the primary sprocket wheels 72R and 72L.

The yoke 70R and 70L for each arm 64R and 64L (see FIG. 2B) has two elongated, generally flat, straight sides 71 which are spaced apart at a distance approximately equal to the outside diameter of the roller wheel 82R and 82L. Located at opposite ends of the yoke 70R and 70L are two semi-circular ends 73 having a diameter generally equal to the diameter of the roller wheel. The two semi-circular ends 73 are spaced apart a distance generally equal to twice the radius at which the shaft 84 is located from the axis of the sprocket wheel shaft 74R and 74L. A cover can be applied over the exterior surface of the yoke to protect the user from contact with the moving parts.

The arms 64R and 64L are positioned so they are operated reciprocatingly (i.e., one is moved forward, while the other is moved rearward). And the yokes 70R and 70L are accordingly positioned relative to the roller wheels. Thus, since each roller wheel 82R and 82L is captured within the yoke 70R and 70L of each arm 64R and 64L and since the arms are operated in opposite directions, the reciprocating motion of the arms is converted into a rotation about a shaft by means of the yoke and roller mechanism. Since the arm driven secondary sprocket wheels are free wheelingly connected to the central shaft 46, the reciprocating motion of the pivot arms 64R and 64L results in rotation of the energy-absorbing wheel 28 independent of the operation of the foot pedals 36R and 36L. Thus, the user can exercise the muscles of the upper body independent of or simultaneous with the exercise of the muscles of the lower body. This is especially convenient since home exercise bicycles are very popular and many purchasers cannot afford two special purpose machines.

From the foregoing description, it will be observed that numerous variations and modifications may be affected without departing from the true spirit and scope of the novel concept of the invention. For example, the pedals, sprocket wheels, and chain could be removed so as to provide exercise for the arms alone. Moreover, a finger controlled gear shift mechanism could be added between the axle 29 and the wheel 28, whereby at the option of the user more or less arm or leg movements would be needed to turn the wheel. It is, of course, intended to cover by the appended claims all such modifications as fall within the scope of the claims.

I claim:

1. An exercise bicycle, comprising:

(a) a frame carrying for rotation a first shaft, a second shaft, and a third shaft;

(b) energy absorbing means rotated on said frame about said first shaft;

(c) first connecting means for free wheeling said second shaft using at least one foot pedal;

(d) second connecting means for rotatably connecting said first shaft and said second shaft;

(e) eccentric wheel means for rotating one roller mounted thereon in a predetermined circular orbit relative to said third shaft;

(f) third connecting means for rotatably connecting said third shaft to free wheel said second shaft;

(g) an arm which is pivotally mounted at one end to said frame and which has an opposite end which is adapted to be pulled by the human hand; and (h) yoke means, carried by said arm at a location intermediate said ends of said arms, for coupling said arm to said one roller such that reciprocating motion of said arm is transferred to rotation said second shaft, said yoke means having one aperture into which said one roller is confined to orbit said third shaft.

2. An exercise bicycle, comprising:

(a) a frame carrying for rotation a first shaft, a second shaft, and a third shaft;

(b) energy absorbing means rotated on said frame about said first shaft;

(c) first connecting means for free wheeling said second shaft using at least one foot pedal;

(d) second connecting means for rotatably connecting said first shaft and said second shaft;

(e) eccentric wheel means for rotating a roller in a predetermined orbit relative to said third shaft;

(f) third connecting means for rotatably connecting said third shaft to free wheel said second shaft, wherein said third connecting means comprises a sprocket wheel coupled to said third shaft, a free wheeling sprocket wheel coupled to said second shaft, and chain means for connecting said sprocket wheel and said free wheeling sprocket wheel;

(g) an arm which is pivotally mounted at one end to said frame and which has an opposite end which is adapted to be pulled by the human hand; and (h) yoke means for coupling said arm to said roller such that reciprocating motion of said arm is transferred to rotation of said second shaft.

3. The bicycle of claim 2 wherein said second connecting means comprises a first pulley rotatably coupled to said first shaft, a second pulley rotatably coupled to said second shaft, and belt means for connecting said first pulley and said second pulley

4. The bicycle of claim 3, wherein said belt means comprises an elastomeric belt and means for adjusting the tension of said belt.

5. The bicycle of claim 2, wherein said first connecting means comprises a fourth shaft mounted for rotation on said frame, a sprocket wheel coupled to said fourth shaft, pair of pedals for rotating said fourth shaft, a free wheeling sprocket wheel which is free wheelingly connected to said second shaft, and means for coupling said sprocket wheel to said free wheeling sprocket wheel.

6. The bicycle of claim 7, wherein said eccentric wheel means comprises: a sprocket wheel having a face which carried an eccentrically rotated pin, said one roller being disposed for rotation on said pin.

7. An exercise bicycle, comprising:

(a) a frame carrying for rotation a first shaft, a second shaft, and a third shaft;

(b) energy absorbing means rotated on said frame about said first shaft;

(c) first connecting means for free wheeling said second shaft using at least one foot pedal;

(d) second connecting means for rotatably connecting said first shaft and said second shaft;

(e) eccentric wheel means for rotating a roller in a predetermined orbit relative to said third shaft;

(f) third connecting means for rotatably connecting said third shaft to free wheel said second shaft;

(g) an arm which is pivotally mounted at one end to said frame and which has an opposite end which is adapted to be pulled by the human hand; and (h) yoke means for coupling said arm to said roller such that reciprocating motion of said arm is transferred to rotation of said second shaft, wherein said yoke means comprises a generally elongated opening having two oppositely disposed long walls which are spaced apart by a distance generally equal to the diameter of said roller and having two oppositely disposed short walls which are spaced apart by a distance generally equal to the diameter of said predetermined orbit.

8. The bicycle of claim 7, wherein said short walls of said opening are generally semicircular in shape, each of said semicircular short walls having a center at the interior of said opening.

9. An exercise machine, comprising:

(a) a frame having mounted for rotation thereon five generally horizontal shafts;

(b) load means, rotatably carried by the first of said five shafts for dissipating energy;

(c) a pair of foot pedals for rotating the second of said of said five shafts;

(d) chain and sprocket means for free wheelingly connecting the third of said five shafts using the rotation of second shaft;

(e) belt and pulley means for rotatably connecting said first shaft and said third shaft;

(f) a pair of arms which are pivotally mounted to said frame and which are adapted to be reciprocated by the human hands, said arms defining intermediate their ends and opening having two parallel, spaced apart, generally straight sides connected together by two semicircular ends;

(g) two roller wheels which are oppositely and eccentrically mounted relative to the fourth and fifth of said five shafts, respectively, and which fit within said openings of said arms to change the reciprocating motion of said arms into rotation of said fourth and fifth shafts; and (h) chain and sprocket means for free wheelingly connecting said third shaft to said fourth shaft and to said fifth shaft, whereby reciprocating motion of said arms drives said energy dissipating means without driving said foot pedals and rotation of said foot pedals drives said energy dissipating means without moving said arms.

10. The machine of claim 9, wherein said load means is disposed between said arms and said rollers.

11. The machine of claim 9, wherein said belt and pulley means are located to one side of said load means.

12. The machine of claim 9, wherein said fourth and fifth shafts are concentric.

* * * * *